US005112036A

United States Patent [19]

Hatt

[11] Patent Number: 5,112,036

[45] Date of Patent: May 12, 1992

[54] OPENER FOR FOLDER PRINTED PRODUCTS

[75] Inventor: Walter Hatt, Yardley, Pa.

[73] Assignee: Graphic Management Associates, Inc., Southborough, Mass.

[21] Appl. No.: 573,493

[22] Filed: Aug. 27, 1990

[51] Int. Cl.[5] ..... B65H 39/02

[52] U.S. Cl. ..... 270/54

[58] Field of Search ..... 270/54, 55, 57, 58

[56] References Cited

U.S. PATENT DOCUMENTS

| | | | |
|---|---|---|---|
| 3,420,516 | 1/1969 | Guggisberg | 270/55 |
| 4,046,367 | 9/1977 | Merker | 270/55 |
| 4,116,427 | 9/1978 | Müller | 270/55 |
| 4,477,067 | 10/1984 | Wise | 270/55 |
| 4,709,910 | 12/1987 | Honegger | 270/55 |
| 4,775,136 | 10/1988 | Peterson | 270/54 |

FOREIGN PATENT DOCUMENTS

| | | | |
|---|---|---|---|
| 423830 | 5/1967 | Switzerland | 270/55 |

*Primary Examiner*—Edward K. Look
*Assistant Examiner*—Therese M. Newholm
*Attorney, Agent, or Firm*—Jordan B. Bierman

[57] ABSTRACT

A device for opening a printed product having three open edges and one folded edge having a pocket which can close to hold the product. A splitter enters the product from one side and divides the pages into approximately equal bundles. A pair of grippers then holds the corners while a spiral enters the opening between the bundles and carries it to the opposite side. At that point, a second pair of grippers holds the opposite corners to thereby hold the bundles against the walls of the pocket. The pocket opens and the product is ready to receive inserts.

12 Claims, 5 Drawing Sheets

OPENER FOR FOLDER PRINTED PRODUCTS

The present Application is directed to a device for opening the pages of a printed product, particularly for the purpose of placing inserts therein.

BACKGROUND OF THE INVENTION

Devices which receive, convey, and open folded printed products to permit inserts therein have been known for many years. U.S. Pat. No. 4,723,770, the disclosure of which is incorporated herein by reference, is an example of one such device particularly adapted for use in placing inserts into newspapers. The outermost section is received by a generally V-shaped pocket which has one stationary wall and one movable wall. The paper is inserted while the walls are separated, they are then brought together and vacuum applied. The vacuum holds the halves of the paper against the walls (which are then separated), thereby causing the paper to open. Any additional sections can then be easily inserted.

The foregoing device works satisfactorily for full sized newspapers. In this situation, the folded paper has only two open edges; namely, the spine or fold, and one side. However, in the case of tabloids, there is only the single fold at the bottom, and the three other edges are all open. The same is true of booklets.

Such printed products present special problems, especially if the paper is thin and flexible. When the vacuum is applied and the pocket opened to permit insertion, the pages tend to curl downward into the V notch. Thus, on insertion, the pages are crumpled and/or torn. This result is, of course, unsatisfactory from a commercial standpoint.

Moreover, it is often important that separation in the pocket take place with approximately half the pages on either side. Usually only the outermost pages are held against the walls of the pocket and the others will fall loosely. Thus, even if crumpling is avoided, the inserts will be placed between the first two pages, increasing the likelihood of tearing.

BRIEF DESCRIPTION OF THE INVENTION

It is among the objects of the present invention to provide a device and system whereby tabloids and similar booklets may be readily separated, into substantially equal bundles of pages, for insertion of additional materials. It is also among the objects of the invention to provide a means whereby such separations can be made even if the spine or binding of the printed product is glued or similarly secured.

In practicing the present invention, there is provided a pocket of the usual sort, having walls which are movable toward and away from one another. Grippers, having open and closed positions, are located at the upper four corners of the two walls. A preopener, reciprocally movable in a direction parallel to the open edge and preferably adjacent thereto, is inserted into the pages in order to separate them into substantially equal portions. A first pair of grippers holds the opened corners against the respective walls of the pocket.

A spiral is inserted into the opening and rotation thereof carries it across the printed product to the opposite corners thereof. At that point, a second pair of grippers, similar to the first, holds the corners against the walls of the pocket. The spiral is then withdrawn from the space between the two groups of pages.

In the foregoing manner, even thin and extremely flexible pages can be properly separated and additional material inserted therebetween. There is no opportunity for the pages to curl or fold downward and the inserts are placed substantially midway between the first and last pages.

BRIEF DESCRIPTION OF THE DRAWINGS

In the accompanying drawings, constituting a part hereof, and in which like reference characters indicated like parts.

DETAILED DESCRIPTION OF THE INVENTION

Figure 1:
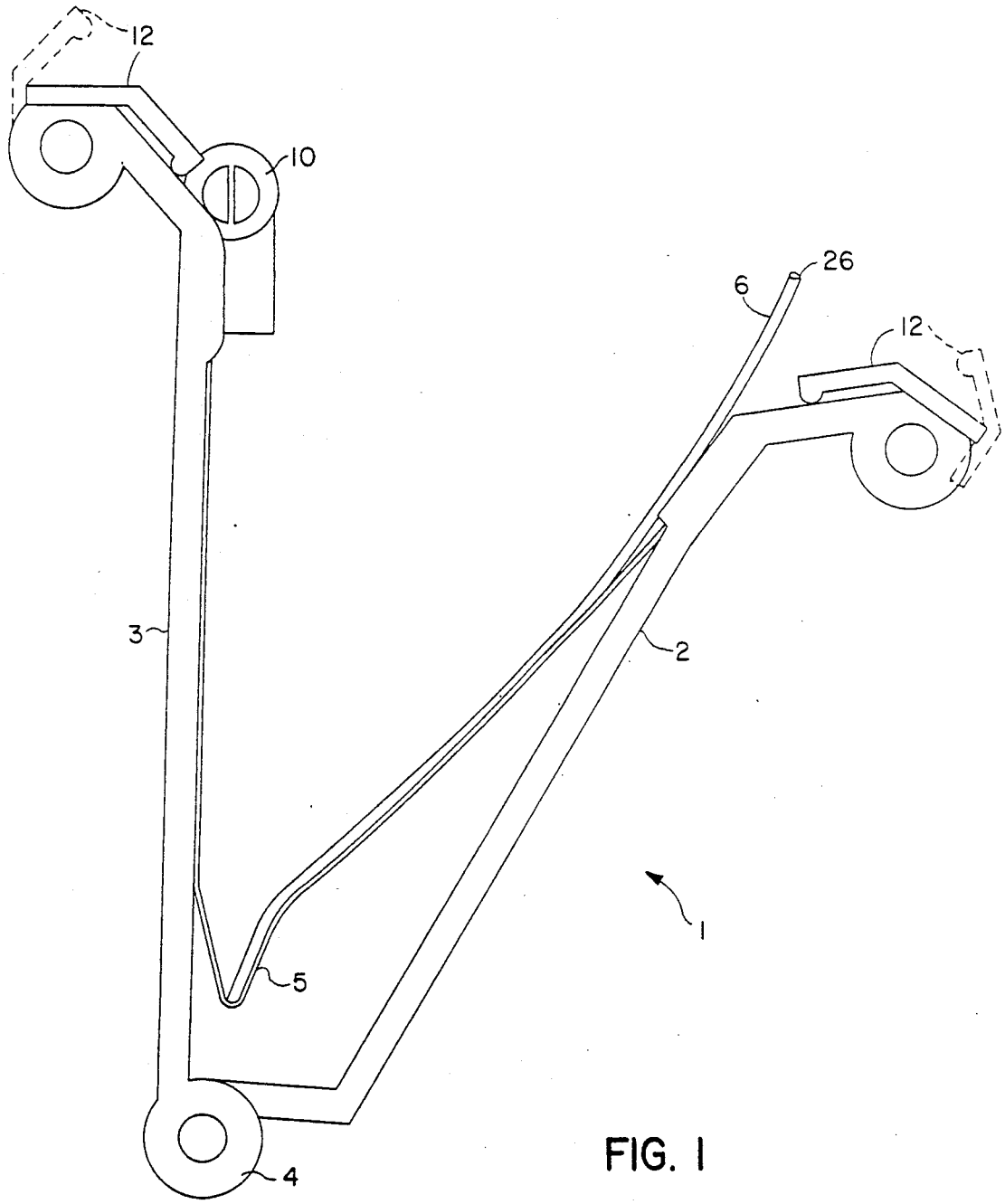
FIG. 1 is a schematic end view, with parts omitted for clarity, of the pocket in its open position with the printed product therein.

The Invention, although applicable to many types of printed products, will be described with relation to a booklet having a folded or glued spine. In FIG. 1, pocket 1 is shown in its open position. It comprises first wall 2 and second wall 3 which are joined at their lower extremities by hinge 4. In this particular embodiment, receiver 5 is located between first wall 2 and second wall 3 and is secured to these walls at least at its upper edges. Booklet 6 rests in receiver 5 and its open edge 26 is adjacent grippers 11 and 12. Grippers 12 are shown in their closed position in full lines and, in their open position, in dotted lines.

Figure 2:
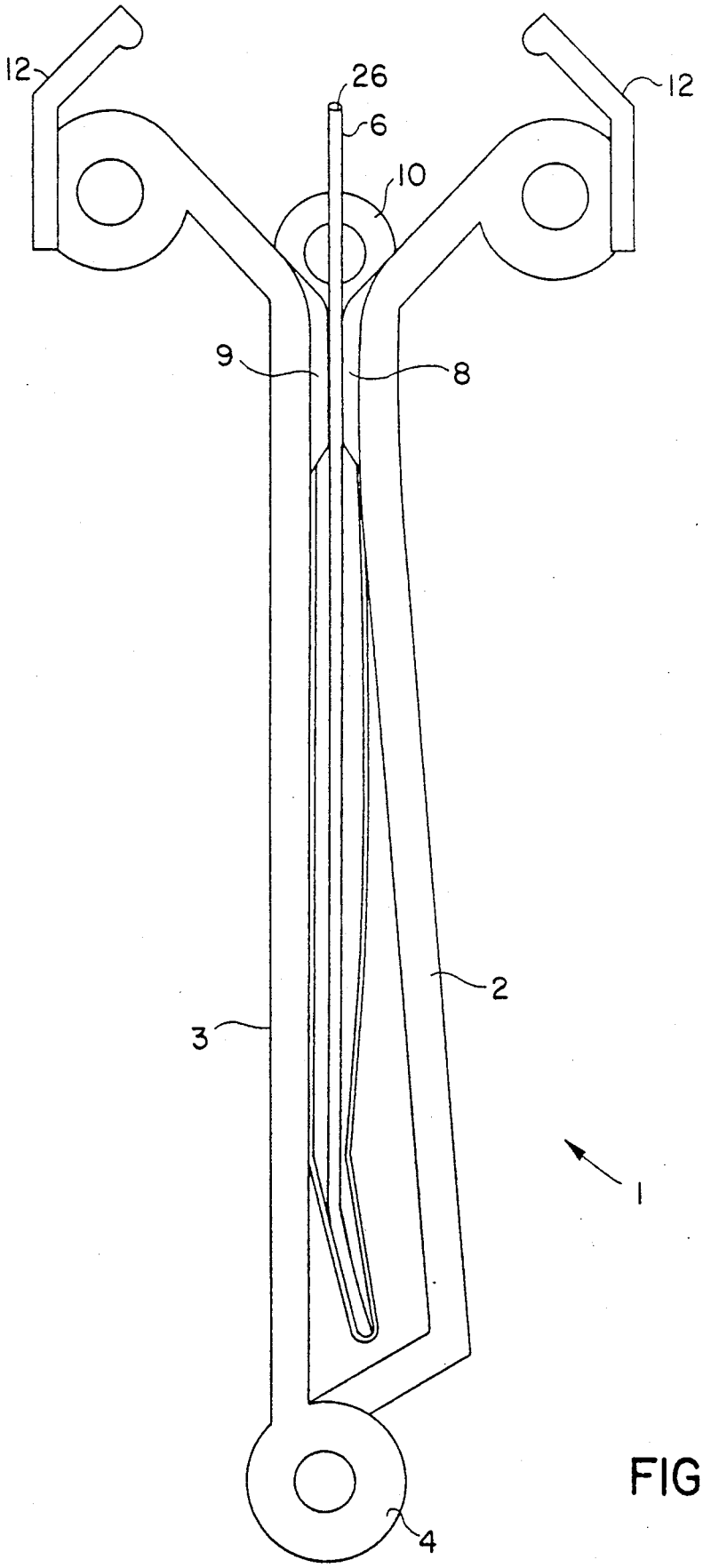
FIG. 2 is a view similar to that of FIG. 1 wherein the pocket is in its closed position.

As can best be seen in FIG. 2, first wall 2 has been rotated about hinge 4 so that first pressure area 8 and second pressure area 9 hold booklet 6 firmly therebetween. This prevents unwanted sliding or slipping of the booklet during splitting. Preopener 10 is in position ready to divide the pages of booklet 6 into two approximately equal groups.

Figure 3:
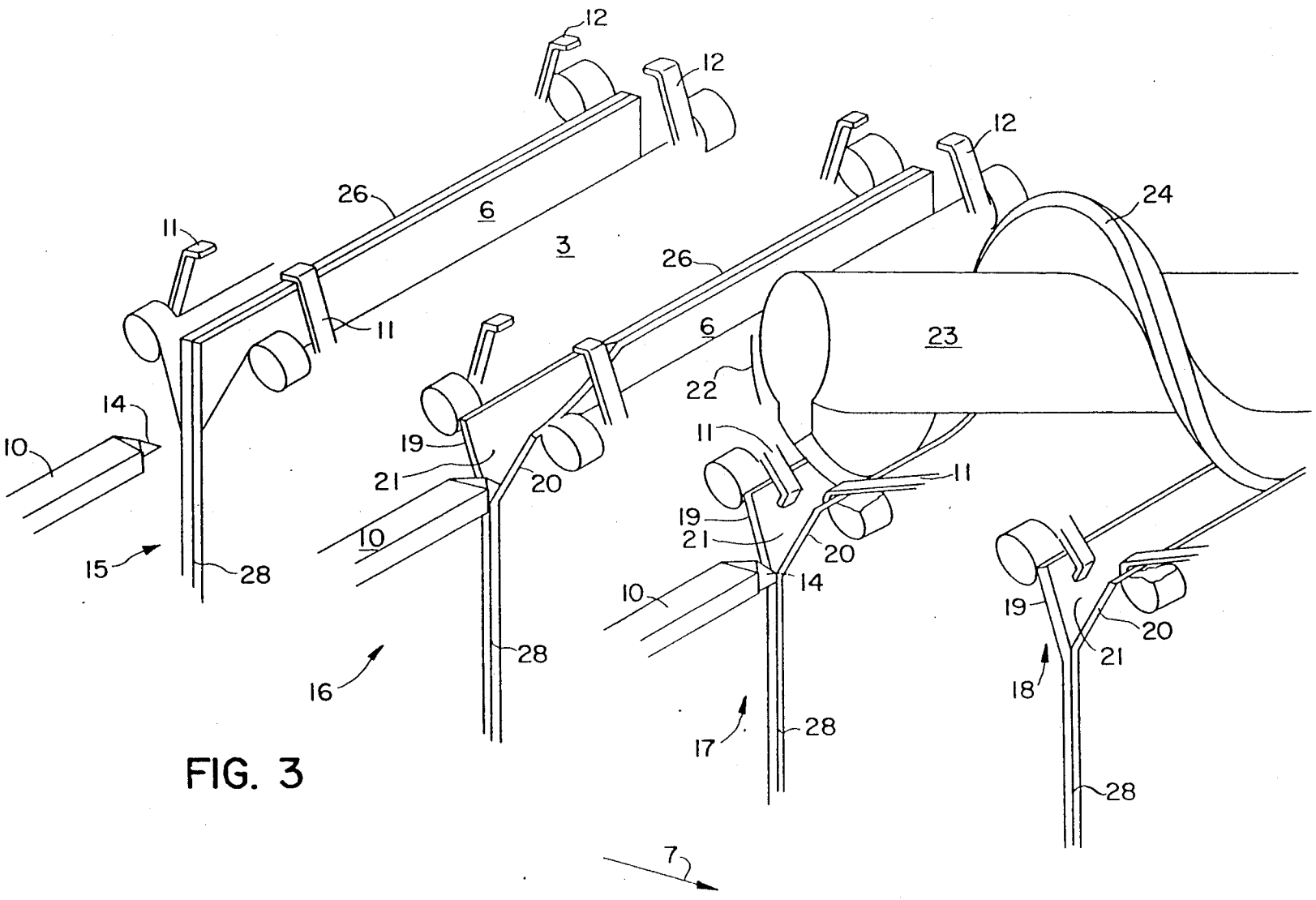
FIG. 3 is a schematic perspective view, with parts omitted for clarity, showing the progression of movement of the device of the present invention.
Figure 4:
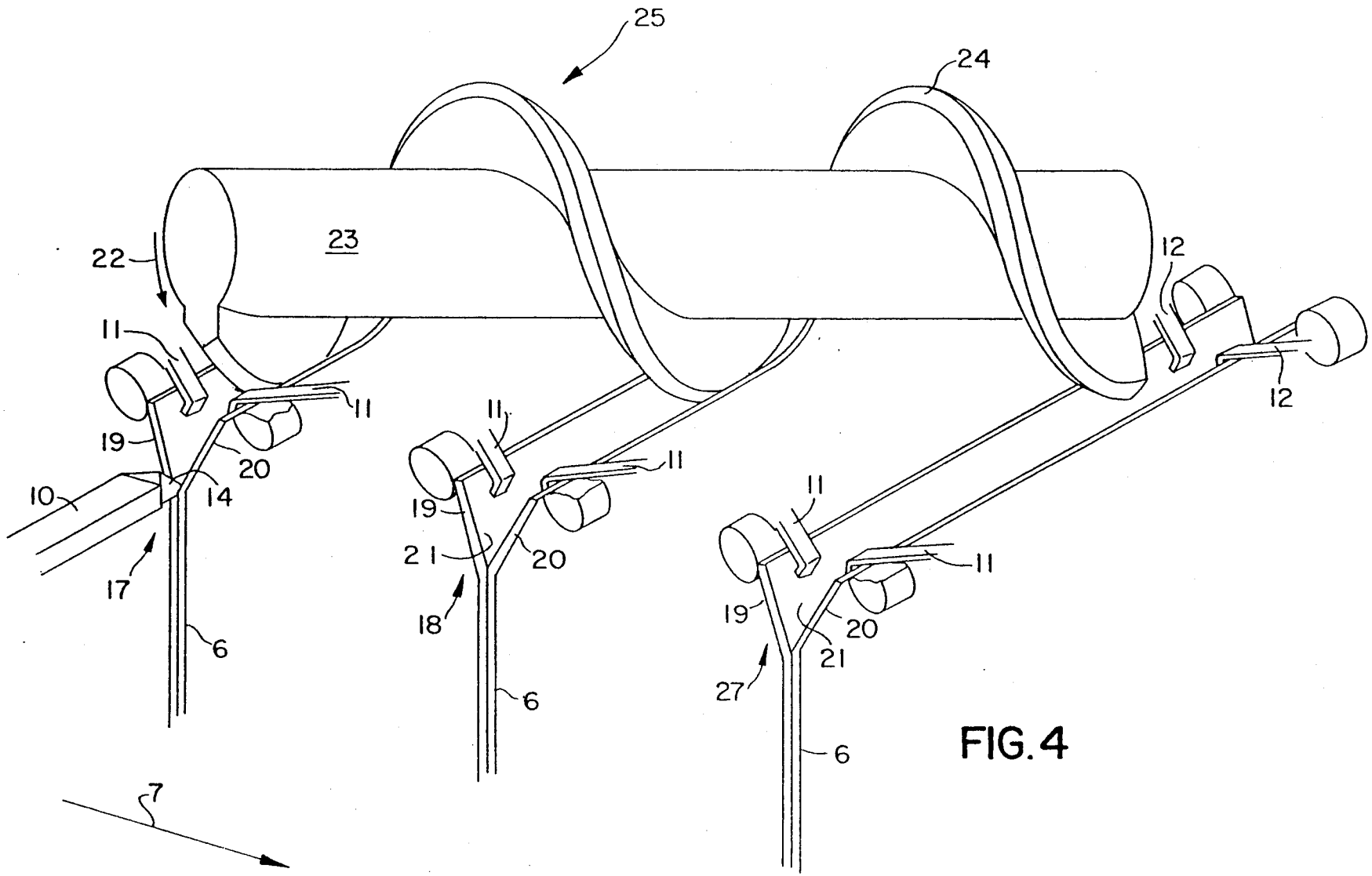
FIG. 4 is a further progression similar to and overlapping FIG. 3 more clearly showing the spiral and its action in dividing the pages into two equal groups.

FIGS. 3 and 4 show preopener 10 provided with splitter 14 which approaches side 28 in position 15. At this point, grippers 11 and 12, of slightly different shape from those in FIGS. 1 and 2, are open and booklet 6 is held by pressure areas 8 and 9 as shown in FIG. 2. At position 16, splitter 14 of preopener 10 has entered booklet 16 at side 28 dividing the pages into first bundle 19 and second bundle 20, thereby creating opening 21. Grippers 11 are then rotated closed as shown in position 17. In this way, bundles 19 and 20 are securely retained in their appropriate positions against walls 2 and 3 of pocket 1.

Main opener 25 (see FIG. 4) comprises barrel 23 rotatable about its axis and which carries spiral 24 extending radially outwardly therefrom. The axis of barrel 23 is placed at an angle to direction of movement 7 of pockets 1.

The angle of the axis of barrel 23 to direction of movement 7 is a function of the speed of movement of the pockets in direction of movement 7, the width of booklet 6, the angle of spiral 24, and the speed of rotation of barrel 23. One end of spiral 24 enters opening 21 and, as it rotates about its axis in the direction of arrow 22, the portion projecting into opening 21 "moves across" the width of booklet 6. Position 18 shows the portion approximately midway between the sides of booklet 6 and position 27 shows it substantially at the end of its "travel". At this point, second grippers 12 close and retain the adjacent corners of groups 19 and 20 against walls 2 and 3, respectively.

Figure 5:
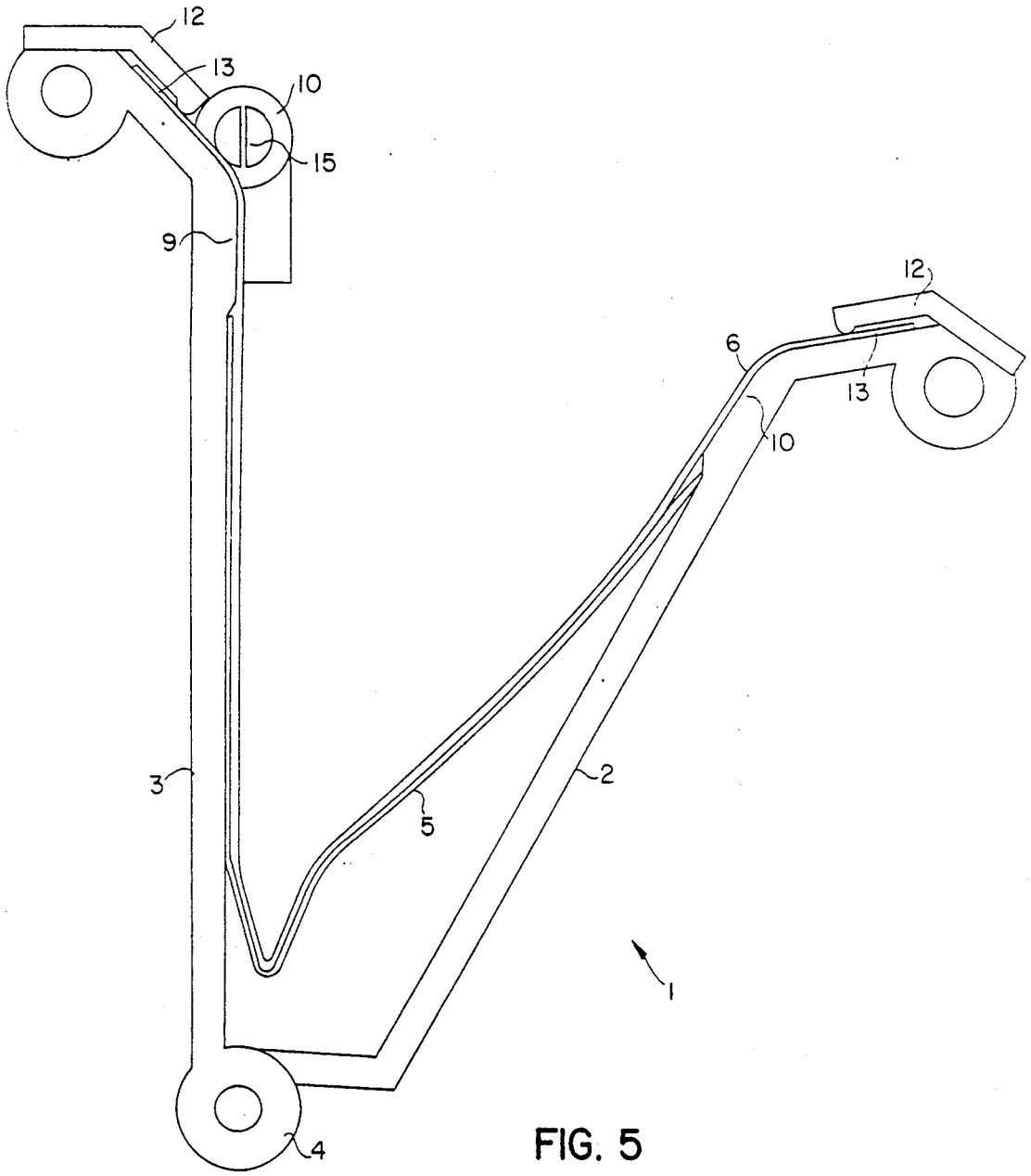
FIG. 5 is a view similar to FIG. 1 wherein the paper product is ready to receive inserts.

First wall 2 then pivots about hinge 4 to its open position as shown in FIG. 5. Edges 13 are securely held by grippers 12, thereby eliminating any possibility of the pages of booklet 6 curling downward and interfering with proper insertion of additional material. In this view, of course, grippers 11 are not visible. At the same time, the pages have been divided into approximately equal bundles so that insertion can take place at the proper place. Thus, the objects of the invention are achieved.

At this point, the operation of the present invention is complete and the booklet is ready to receive the desired inserts.

While only a limited number of specific embodiments of the present Application have been expressly described, it is, nonetheless, to be broadly construed and not to be limited except by the character of the claims appended hereto.

I claim:

1. A device for opening a printed product which has a folded edge, an open edge parallel to and spaced apart from said folded edge, and first and second open sides extending between said open edge and said folded edge, said device comprising a pocket adapted to hold said printed product and having a first wall and a second wall connected by a hinge, said first wall and said second wall pivoted at said hinge for motion toward each other into a closed position and away from each other into an open position, a preopener comprising a splitter adapted for movement parallel to said open edge and toward said first open side when said pocket is in said closed position, and away from said open side, whereby said splitter is inserted into said printed product at said open edge, thereby separating said product into two groups of pages at a first location adjacent said first side and said open edge, a pair of first grippers adjacent said first location, each of said first grippers adapted to retain one of said groups in spaced apart relation to the other of said groups, thereby forming a gap therebetween, a spreader comprising a spiral adapted for insertion into said gap and for movement from said gap to a second location adjacent said open edge and said second side, thereby extending said gap substantially to said second location, a pair of second grippers adjacent said second location, each of said second grippers adapted to retain one of said groups in spaced apart relation to the other of said groups, whereby at least one insert can be placed between said groups.

2. The device of claim 1 wherein said first wall is movable and said second wall is stationary.

3. The device of claim 1 wherein there is a plurality of said pockets spaced apart along a conveyor which moves in a longitudinal direction.

4. The device of claim 1 wherein said folded edge is a glued spine.

5. The device of claim 1 wherein at least one of said first wall and said second wall has a pressure area which presses against the other of said first wall and said second wall, whereby said printed product is gripped between said first wall and said second wall at said pressure area.

6. The device of claim 5 wherein said pressure area is on both said first wall and said second wall.

7. The device of claim 1 wherein there is a receiver within said pocket adapted to hold said printed product.

8. The device of claim 7 wherein said receiver is attached to said pocket at least at an outer edge parallel to and remote from said hinge.

9. The device of claim 3 wherein said spreader comprises a generally cylindrical member rotatable about its axis, said spiral mounted on said member, said axis being at an angle to said direction of more than 0° and less than 90° whereby, as said member rotates, said spiral describes a path corresponding to movement of said pocket in said longitudinal direction and speed of movement of said spiral parallel to said open edge to said second side.

10. The device of claim 3 wherein said first wall is movable and said second wall is stationary, said second wall is forward of said first wall in said direction.

11. The device of claim 3 wherein said hinge leads said pocket in said direction whereby said first wall and said second wall are at a negative angle to a vertical line.

12. A device for separation of edges of a group of pages while said pages are being conveyed in a linear direction, said device comprising a generally cylindrical member, rotatable about its axis at an angle to said linear direction greater than 0° and less than 90°.

* * * * *